United States Patent [19]

Scully et al.

[11] Patent Number: 4,841,838

[45] Date of Patent: Jun. 27, 1989

[54] ARMOR RETENSION MECHANISM HAVING ANTI-THEFT MEANS

[76] Inventors: Andrew J. Scully, 39290 Tunstall Dr., Mt. Clemens, Mich. 48044; Arthur H. Adlam, 12215 Canal, Sterling Heights, Mich. 48078

[21] Appl. No.: 111,487

[22] Filed: Oct. 13, 1987

[51] Int. Cl.[4] ..... F41H 5/16; F41H 5/20

[52] U.S. Cl. ..... 89/36.08; 411/910

[58] Field of Search ..... 89/36.02, 36.09, 36.13, 89/36.15, 36.16, 36.08, 36.07, 36.06, 36.04; 52/385, 422, 391; 403/388; 29/402.17, 402.16, 402.13, 402.15; 228/139, 140, 185; 411/177, 222, 237, 910

[56] References Cited

U.S. PATENT DOCUMENTS

| | | | |
|---|---|---|---|
| H000,129 | 9/1986 | Hansen | 89/36.08 |
| 453,076 | 5/1891 | Comstock | 228/139 |
| 2,380,393 | 6/1945 | Berg | 89/36.08 |
| 2,708,844 | 5/1955 | Cincel | 411/910 |
| 4,167,889 | 9/1979 | Bohne et al. | 89/36.02 |
| 4,263,831 | 4/1981 | Smith | 411/171 |
| 4,368,660 | 1/1983 | Held | 89/36.17 |
| 4,398,446 | 8/1983 | Pagano et al. | 89/36.08 |

FOREIGN PATENT DOCUMENTS

| | | | |
|---|---|---|---|
| 668736 | 8/1963 | Canada | 228/139 |
| 717081 | 2/1942 | Fed. Rep. of Germany | 411/222 |
| 3516671 | 11/1986 | Fed. Rep. of Germany | 89/36.08 |
| 2369903 | 7/1978 | France | 29/402.16 |
| 173057 | 10/1983 | Japan | 29/402.13 |
| 2067699 | 7/1981 | United Kingdom | 411/910 |

*Primary Examiner*—Deborah L. Kyle
*Assistant Examiner*—Stephen Johnson

[57] ABSTRACT

Armor panels are bolted to the outer walls of a military vehicle. Anti-theft collars are welded to the outer faces of the panels in surrounding relation to the bolt heads, to prevent unauthorized unscrewing or unloosening of the bolts.

9 Claims, 1 Drawing Sheet

ARMOR RETENSION MECHANISM HAVING ANTI-THEFT MEANS

GOVERNMENT INTEREST

The invention described herein may be manufactured, used, and licensed by or for the Government for governmental purposes without payment to us of any royalty thereon.

SUMMARY OF THE INVENTION

This invention relates to add-on armor for military vehicles, especially improved means for attaching armor plates to outer surfaces of a military vehicle. A particular aim of the invention is to incorporate an anti-theft mechanism into the attachment means.

The need for the anti-theft mechanism arises primarily because of a desire on the part of military officials to deter (prevent) enemy forces from gaining an insight into the ballistic capabilities of the add-on armor plates, e.g., by surreptitious removal of one or more plates from a vehicle.

In the past it was sometimes considered necessary or desirable to post guards in the vicinity of vehicles equipped with add-on armor panels, as a deterrent to the unauthorized removal of an armor panel from a vehicle. THe present invention is directed to an anti-theft mechanism built into the devices that are used to attach the armor panels to military vehicles. The anti-theft mechanisms are designed so that they can be removed when necessary, e.g., to repair damaged panels and/or replace the existing panels with other panels having different ballistic performance.

THE DRAWINGS

THE DRAWINGS IN GREATER DETAIL

Figure 1:
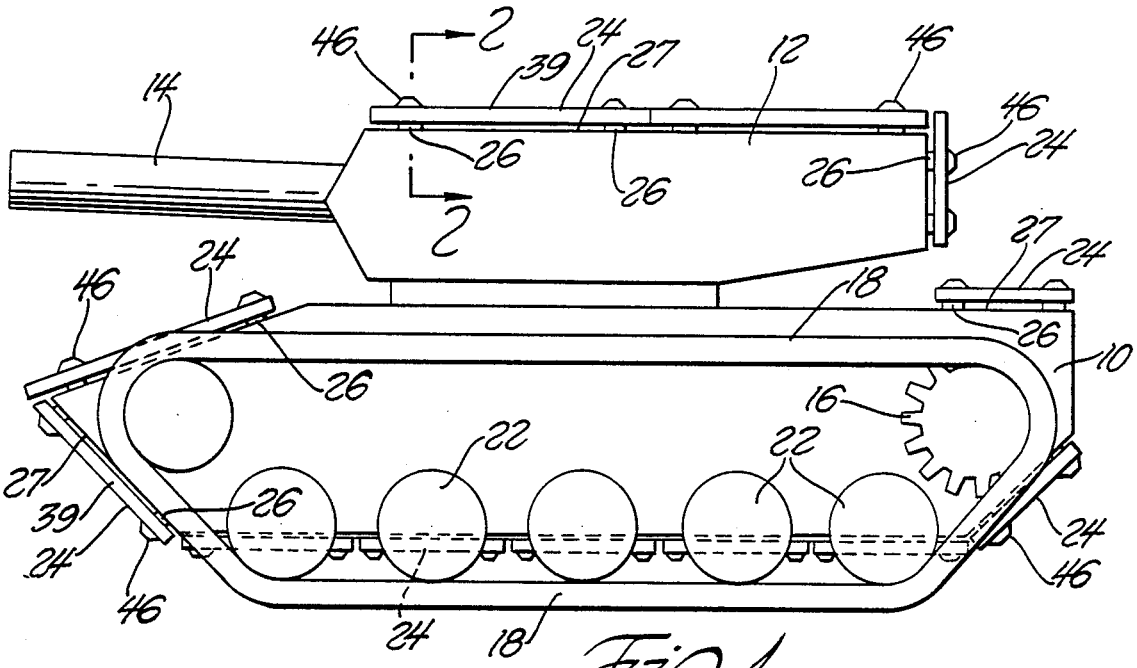
FIG. 1 is a side elevational view of a military vehicle utilizing our invention.

FIG. 1 shows a conventional military vehicle comprising a hull 10, rotary turret 12, and main gun 14. The vehicle propulsion system comprises an engine-transmission mechanism located within the hull in operative driving relation to drive sprockets 16 at the rear end of the vehicle. Endless tracks 18 are trained around sprockets 16, front idler wheels 20, and road wheels 22.

Add-on armor plates (panels) 24 are detachably mounted on selected vehicle surfaces to enhance battlefield survivability of the vehicle. The panels may be constructed of various different armor materials; the plate material depends to a certain extent on such factors as location on the vehicle (vehicle upper surface may require different material than the undersurface), or weight-performance tradeoff factors, or technology advances in ballistic materials development. Some illustrative armor materials are disclosed in U.S. Pat. No. 4,398,446 to Pagano et al and U.S. Pat. No. 4,368,660 to M. Held.

Figure 2:
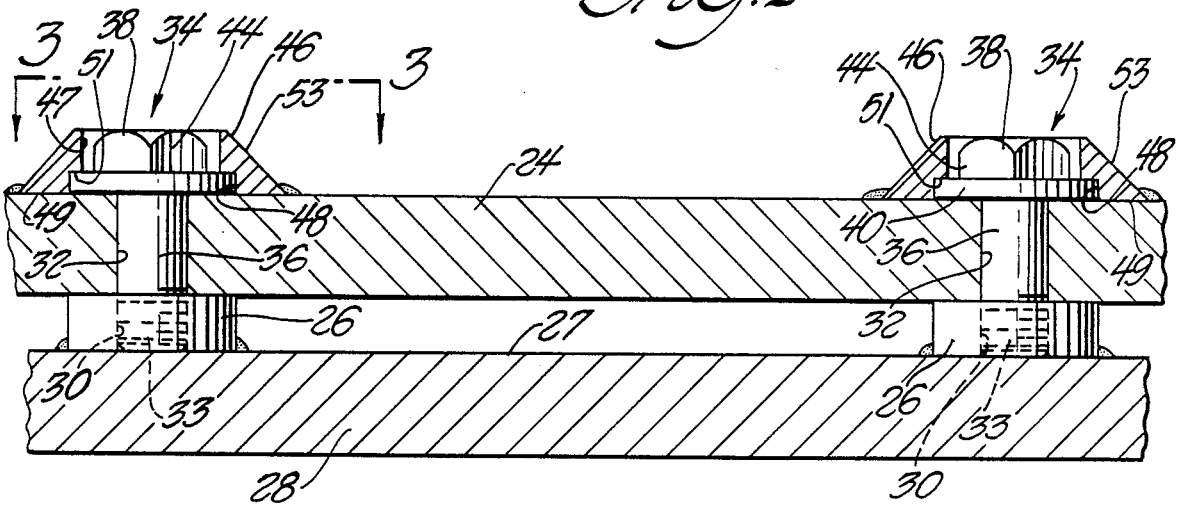
FIG. 2 is an enlarged fragmentary sectional view taken on line 2—2 in FIG. 1.
Figure 3:
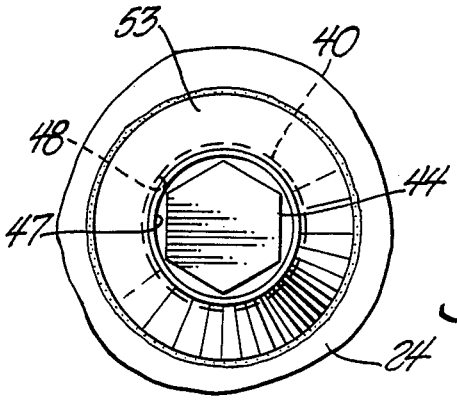
FIG. 3 is a fragmentary plan view taken in the direction of line 3—3 in FIG. 2.

FIG. 2 illustrates a preferred mechanism for mounting an individual armor plate on the vehicle. The mechanism comprises a plural number of pads 26 welded to outer surface 27 of a vehicle wall 28. In most cases individual plates 24 are square or rectangular in plan outline; Four mounting pads 26 are used for each plate; typically the pads are located near corner areas of the associated armor plate (when the plate is in its mounted position).

Each pad 26 has a threaded opening 30 extending therethrough. The associated armor plate 24 is formed with circular through holes 32 spaced apart in accordance with the spacing of the various threaded openings 30.

A bolt 34 is extended through each hole 32 such that a threaded section 33 on the bolt screws into threaded opening 30. A smooth-surfaced section 36 on the shank area of the bolt is mated to the surface of associated hole 32. By using templates to accurately locate holes 32 and pads 26 it is possible to have the diameter of each bolt section 36 closely approach the hole 32 diameter, thereby ensuring a firm vibration-resistant mounting of plate 24 on the vehicle.

Each mounting bolt 34 includes an enlarged head 38 that overlies the outer face 39 of plate 24 to exert a clamping force thereon. The enlarged head 38 of the bolt comprises a circular base section 40 engageable on the outer face 39 of armor plate 24. The bolt head also includes a non-circular (e.g., hexagonal) section 44 sized to receive a wrench for bolt-turn purposes.

Our invention is concerned largely with anti-theft collars 46 adhered to face 39 of armor plate 24 in surrounding relation to head areas 38 of the mounting bolts 34. Welding is the preferred method of adhering each collar 46 to plate 24. The various collars 46 are welded to plate 24 after the associated bolts 34 have been screwed down into pads 26 to a desired torque value suitable for retaining plate 24 in place on the pads.

Each collar 46 is formed with a relatively small diameter opening 47 having a diameter slightly greater than the major diameter across corner areas of bolt head 38. A relatively large diameter counterbore 48 is formed in end face 49 of collar 46 to encircle the base section 40 of the bolt head.

The juncture between opening 47 and counterbore 48 forms an annular shoulder surface 51 that overlies circular base section 40 of bolt head 38. This relationship prevents the bolt from being unscrewed from pad 26 except after removal of collar 46 from armor plate 24. Such removal requires the use of a cutting torch to sever the weld connections between the collar and armor plate.

The axial dimension of counterbore 48 is preferably selected so that shoulder surface 51 closely overlies the radial face of circular section 40 of the bolt head. With a very close tolerance fit of surface 51 on the face of section 40 the bolt head is prevented from turing or loosening, as might result in vibrational play of plate 24 relative to pads 26.

If the axial dimension of counterbore 48 is somewhat greater than the axial dimension of circular section 40 there is a possibility that the bolt could slightly loosen or unscrew from pad 26. However, eventually circular section 40 would abut shoulder surface 51 to thereafter prevent any further unloosening of the bolt. Collar 46 serves as an anti-theft device to prevent surreptitious (unauthorized) removal of armor plate 24 from the vehicle on which it is mounted.

Each collar 46 preferably has approximately the same aixal dimension as the associated bolt head 38. This relationship minimizes the axial projection of the bolt-collar assembly from the outer face 39 of armor plate 24. This is advantageous in slightly minimizing the size of the target presented to the enemy force (concealment and/or enemy projectile avoidance). In a typical situation collar 46 would have an axial dimension of about three eighth inch.

The annular side surface 53 of each collar 46 is a frusto-conical surface tapering from collar end surface 49 at an angle of about forty five degrees. The primary purpose of the frusto-conical surface is to prevent the collar from being gripped by a wrench, thereby preventing removal by application of sufficient torque to break the welds. The frusto-conical surface also somewhat minimizes the profile (size) of the collar, thereby somewhat reducing the possibility of a direct hit by an enemy projectile.

The primary function of each collar 46 is as an anti-theft device, i.e., prevention of the bolt from being unloosened by an unauthorized person. However, the collar may also offer some ballistic protection for the otherwise unprotected bolt head 38. Collar 46 surrounds the bolt head and acts as a shield against oblique attack of the bolt head by an enemy projectile or armor fragmentation spray.

As noted previously, our invention relates primarily to the relationship between the hold-down bolts and associated anti-theft collars. The use of bolts to affix armor panels to vehicle surfaces is not new, per se. U.S. Pat. No. 2,380,393 to Berg shows a bolt system in an armor fastener environment. U.S. Pat. No. 4,167,889 also shows the use of bolts to retain armor panels in place on military vehicles.

We wish it to be understood that we do not desire to be limited to the exact details of construction shown and described for obvious modifications will occur to a person skilled in the art, without departing from the spirit and scope of the appended claims.

We claim:

1. In a military vehicle having an outer surface and a plural number of add-on armor plates applied to said outer surface to provide increased ballistic protection for the vehicle: the improvement comprising means for mounting individual armor plates on the vehicle outer surface; each said mounting means comprising a plural number of pads adhered to the vehicle outer surface; each pad having a threaded opening therein; each armor plate having holes therethrough spaced apart the same distances as said threaded openings; a bolt extending through each hole in the armor plate into the threaded opening in the associated pad; each bolt having a threaded section meshed with a threaded surface in the pad, a smooth shank surface engaged with the hole surface in the armor plate, and an enlarged head overlying the outer face of the armor plate; each bolt head comprising an inner circular base section engaged with the outer face of the armor plate and an outer non-circular section sized to receive a wrench for bolt-turn purposes; and an annular anti-theft collar for each bolt; each collar being fixed upon the outer face of the add-on armor plate in surrounding relation to the head of the associated bolt; each said collar having a relatively small central opening accommodating the non-circular section of the bolt, and a relatively large counterbore accommodating the circular base section of the bolt, whereby the bolt is prevented from being unthreaded out of the pad except after removal of the collar from the outer face of the armor plate.

2. In a military vehicle having an outer surface and a plural number of add-on armor plates applied to said outer surface to provide increased ballistic protection for the vehicle: the improvement comprising means for mounting individual armor plates on the vehicle outer surface; each said mounting means comprising a plural number of pads adhered to the vehicle outer surface; each pad having a threaded opening therein; each armor plate having holes therethrough spaced apart the same distances as said threaded openings; a bolt extending through each hole in the armor plate into the threaded opening in the associated pad; each bolt having a threaded section meshed with a threaded surface in the pad, a smooth shank surface engaged with the hole surface in the armor plate, and an enlarged head overlying the outer face of the armor plate; each bolt head comprising an inner circular base section engaged with the outer face of the armor plate and an outer non-circular section sized to receive a wrench for bolt-turn purposes; and an annular anti-theft collar for each bolt; each collar being fixed upon the outer face of the add-on armor plate in surrounding relation to the head of the associate bolt; each said collar having a relatively small central opening accommodating the non-circular section of the bolt, and a relatively large counterbore accommodating the circular base section of the bolt, whereby the bolt is prevented from being unthreaded out of the pad except after removal of the collar from the outer face of the armor plate wherein each collar has a flat inner end surface, an outer end surface parallel to said inner end surface, and an annular side surface interconnecting the two end surfaces, each annular side surface being a frusto-conical surface tapering from the inner end surface to the outer end surface.

3. The improvement of claim 2 wherein each collar has approximately the same axial thickness as the axial thickness of the head on the associated bolt.

4. The improvement of claim 2 wherein the frusto-conical side surface has an angle of about forty-five degrees to the flat inner end surface.

5. The improvement of claim 2 wherein each collar is welded to the outer face of the associated armor plate.

6. In a vehicle having an outer surface and an armored plate fixed upon the outer surface, the plate having one side faced toward the outer surface and an opposite side faced away from the surface: the improvement comprising means for mounting the armor plate on the outer surface including a pad fixed to the outer surface; a fastener extending through the plate into threaded engagement with the pad; the fastener comprising a head on the opposite side of the plate, a tool engagement surface disposed about the periphery of the head and a flange on the head face against the plate; an annular collar formed as a separate element from the fastener, the collar directly fixed to the armor plate and encircled about the head of the fastener; the collar defining a through hole having a smaller diameter section, the smaller diameter section having a side wall which opposes the tool engagement surface of the fastener, the through hole further having a larger diameter section to accommodate the flange on the head of the fastener; the smaller diameter section and the larger diameter section defining therebetween a shoulder for keeping the flange at the surface of the armored plate, whereby the fastener is prevented from being unthreaded out of the pad.

7. The device of claim 6 wherein a plurality of points on the tool engagement surface on the head of the fastener are next to the smaller diameter section of the annular collar.

8. The device of claim 7 wherein the head has a longitudinal axis, one axial end of the head having the flange and the other axial end of the head substantially coplanar with one axial end of the collar.

9. The device of claim 8 wherein the collar has an outer peripheral surface defining a frusto-conical shape having a larger diameter end and a smaller diameter end, the larger diameter end of the frusto-conical shape being adjacent the armor plate.

* * * * *